US006659317B2

(12) United States Patent
Borson

(10) Patent No.: US 6,659,317 B2
(45) Date of Patent: Dec. 9, 2003

(54) QUICK DRAW TOOL HOLDER

(76) Inventor: James Timothy Borson, 1505 N. 28th Ave. W., Duluth, MN (US) 55806

( * ) Notice: Subject to any disclaimer, the term of this patent is extended or adjusted under 35 U.S.C. 154(b) by 75 days.

(21) Appl. No.: 10/127,140

(22) Filed: Apr. 22, 2002

(65) Prior Publication Data

US 2002/0153394 A1 Oct. 24, 2002

Related U.S. Application Data

(60) Provisional application No. 60/285,888, filed on Apr. 23, 2001.

(51) Int. Cl.[7] ..... A45F 5/00

(52) U.S. Cl. ..... 224/183; 224/234; 224/245; 224/904

(58) Field of Search ..... 224/183, 234, 224/245, 904, 242, 246, 666, 677

(56) References Cited

U.S. PATENT DOCUMENTS

| | | | | | |
|---|---|---|---|---|---|
| 1,928,063 | A | * | 9/1933 | Lehmann | 224/234 |
| 2,956,715 | A | | 10/1960 | Henderson | |
| 3,100,590 | A | * | 8/1963 | Bohlsen | 224/242 |
| 3,130,883 | A | * | 4/1964 | MacKool | 224/232 |
| 3,384,277 | A | * | 5/1968 | Hodelka | 224/242 |
| D248,797 | S | * | 8/1978 | Sanders | D3/215 |
| 4,264,024 | A | * | 4/1981 | Harris, Jr. | 224/250 |
| 4,372,468 | A | | 2/1983 | Harvey | |
| 4,790,461 | A | | 12/1988 | Stover | |
| 5,195,667 | A | | 3/1993 | Gallant | |
| 5,248,072 | A | | 9/1993 | Jones | |
| 5,992,716 | A | | 11/1999 | Riley | |
| 6,102,264 | A | | 8/2000 | Redzisz | |
| 6,497,349 | B1 | * | 12/2002 | Ramirez | 224/245 |

* cited by examiner

*Primary Examiner*—Jes F. Pascua

(57) ABSTRACT

The present invention is directed to a device for securely holding and carrying a "T" or "L" shaped tool with the handle in a ready-to-use position. The tool is placed into and withdrawn from the holder by a natural swinging motion with the user maintaining his normal grip on the handle. The holder of the present invention comprises a T-shaped body having perpendicular horizontal and vertical cavities each open on the front side thereof to a longitudinal channel. The head of the tool accesses the horizontal cavity through the horizontal channel and the neck of the tool accesses the vertical cavity through the vertical channel. The horizontal cavity of the holder preferably has means for securing the head of the tool, e.g. a magnet, with the striking face of the head facing in the rearward direction, and the vertical cavity of the holder preferably has means for securing the neck of the tool, e.g. an adjustable spring clip that grasps the neck of the tool, leaving the handle of the tool free for the user to grasp. The tool is released easily when the user grabs the handle and removes the tool for use. In this way, the user doesn't have to change his hand position from the 'in use' position to the 'storage' position. In addition, the handle of the tool is kept up and out of the way of the user's legs, especially when walking, kneeling or climbing.

13 Claims, 5 Drawing Sheets

QUICK DRAW TOOL HOLDER

CROSS-REFERENCE TO RELATED APPLICATIONS

Applicant claims the benefit under 35 USC 119(e) of Provisional Application No. 60/285,888, filed Apr. 23, 2001.

BACKGROUND OF INVENTION

1. Field of the Invention

This invention relates to the field of holding and carrying devices for manual (as opposed to power) hand tools, particularly T-shaped or L-shaped hand tools.

2. Description of Related Art

Extensive efforts have been directed in the prior art to finding ways in which small manual hand tools can be carried comfortably and securely on the user's person, yet remain readily accessible for use. Tools that have elongated handles and transversely mounted heads (herein also referred to as "T-shaped" or "L-shaped" tools) have always presented particular problems because of their configuration. Examples of such tools are hammers, mallets, hatchets, axes, picks, etc. Carrying devices for such tools have ranged from simple loops in the user's clothing to specially designed holders mounted on utility belts or tool pouches. Typically, the devices of the prior art comprise a loop or cradle into which the head of a hammer or other similarly shaped tool is placed, with the handle of the tool descending vertically below the head of the tool. When the tool is need for the job, the hammer is removed from the loop by lifting the hammer vertically from the cradle or loop, and when the job is finished, the procedure is essentially reversed. As useful as these arrangements are, the vertically dangling handle interferes with the user's legs while walking, kneeling, or climbing, and the tool is sometimes prone to falling out of its holder. In addition, the vertical motions required to remove and re-insert the tool are awkward and inefficient, in large part because the user must subsequently re-position his or her grip on the handle in order to use the tool.

Several approaches have been taken in the prior art to secure a T-shaped tool within a holder, yet still make the tool accessible. For example, Gallant, et al. U.S. Pat. No. 5,195,667 describes a device for suspending a T-shaped tool from a belt, toolbox, wall, or other mount, comprising a rotating holder body having a spring-loaded securing receptacle that secures the tool while allowing the tool to be inserted and removed from different angles. This device provides for access to the tool with a more natural hand motion, but still orients the handle of the tool below the head. Examples of other devices designed to grasp the head of a T-shaped tool while allowing the handle to be disposed vertically below the head include Harvey U.S. Pat. No. 4,372,468; Riley et al. U.S. Pat. No. 5,992,716; Jones et al. U.S. Pat. No. 5,248,072; Redzisz et al. U.S. Pat. No. 6,102,264; and Stover U.S. Pat. No. 4,790,461.

Some attempts have also been made in the prior art to orient the handle of a T-shaped tool above the head. For example, Henderson U.S. Pat. No. 2,956,715 teaches a tool holder for hammer-like tools in which a socket near the bottom of the holder receives the head, a clip near the top of the holder receives the helve (handle), and a ledge positioned to engage the widened part of the head adjacent to the neck serves as a fulcrum around which the tool rotates during withdrawal and re-insertion. In this arrangement, the tool can be withdrawn from the holder only by executing a specific pivotal movement in combination with an axial pull on the handle. As another example Bohlsen U.S. Pat. No. 3,100,590 describes a hammer holster having an upwardly opening elongated pocket near its bottom adapted to receive the hammer head, and retaining means, such as a swing lug or flexible cord, near its top to retain the handle against transverse movement. A separate motion is required to move the lug or flexible cord into engagement with the handle before the tool is secured in the holster and out of engagement with the handle when the tool is removed. Although these prior art arrangements exhibit the benefit of "handle-up" positioning of the tool the hand movements required to insert and remove the tool are still unnatural and inconvenient.

BRIEF SUMMARY OF INVENTION

The present invention provides an apparatus that receives and holds a manual hand tool having an elongated handle and transversely mounted head connected by a neck area, for example, a carpenter's or roofer's hammer, a woodsman's axe, a dry-wall hatchet, a climber's pick, a crowbar or similar T-shaped or L-shaped hand tool. Preferably, the holder is mounted on a scabbard or tool pouch that is suspended from a user's belt, with the tool's handle freely extending in an upward position above the tool's head, preferably at about a 45° angle counter clockwise from the vertical. This orientation allows the tool to be removed from and re-inserted into the holder with the same natural swinging or striking motion that is employed in the use of the tool. Retaining means in the holder automatically secure the head and neck of the tool in place without the user releasing his grip from the handle. Therefore, no other motion is required to retain the tool in the holder other than that which is used for insertion and withdrawal.

Accordingly, a primary objective of the present invention is to provide a tool holding and securing apparatus wherein the tool is inserted and withdrawn with only a single normal swinging motion of the user's hand, without the user having to remove his hand from the handle of the tool.

A further objective is to provide a means of securely carrying a 'T' or 'L' shaped tool, with the handle extended upward, above the head of the tool and out of the way of the user's legs as he walks, kneels, or climbs.

A further objective is to provide a tool holder having means for securing a 'T' or 'L' shaped tool by its head and neck area only so that the handle is left freely available in an upright position for grasping by the user.

Other features and advantages of the present invention will become apparent from the following more detailed description, taken in conjunction with the accompanying drawings, which illustrate, by way of example, the principles of the invention.

DETAILED DESCRIPTION OF THE INVENTION

The present invention is particularly suitable for those manual hand tools having an elongated handle and a transversely mounted head connected by an intermediate neck area; i.e. the previously described T-shaped or L-shaped tools. The head of such tools characteristically has a primary striking face on one end and a secondary face on the opposite end. Typically the tool head is made of a metal material, such as iron, steel, aluminum or an alloy. Examples of such tools are various types of hammers, including but not limited to, carpenter's hammers, roofer's hammers, claw hammers and ball peen hammers; as well as mallets, hatchets, drywall hatchets, axes, picks, pry-bars and so forth.

Figure 1:
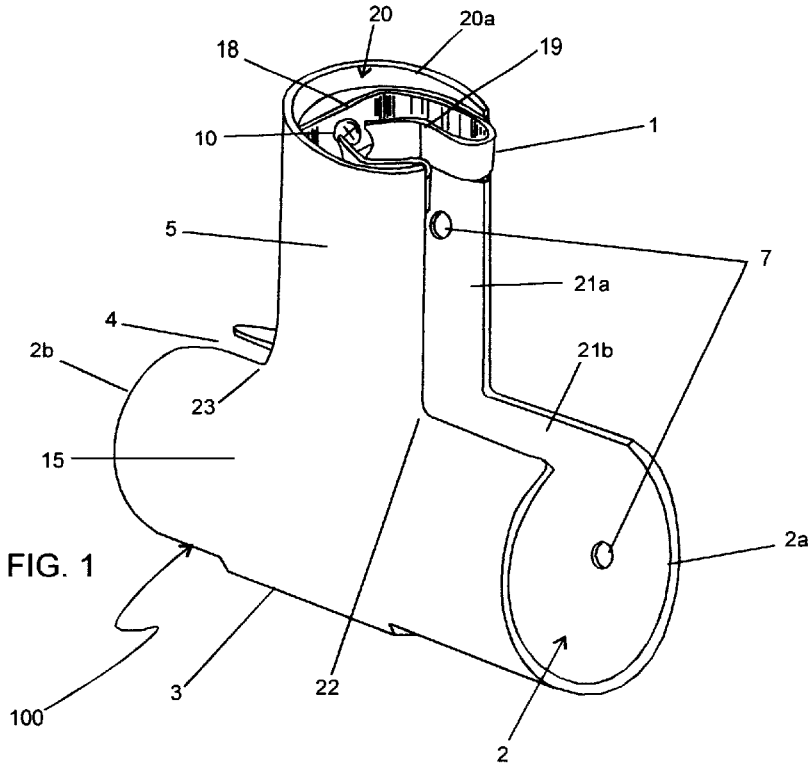
FIG. 1 is a perspective view of the preferred embodiment of the present invention showing an adjustable clip in the vertical member thereof.
Figure 2:
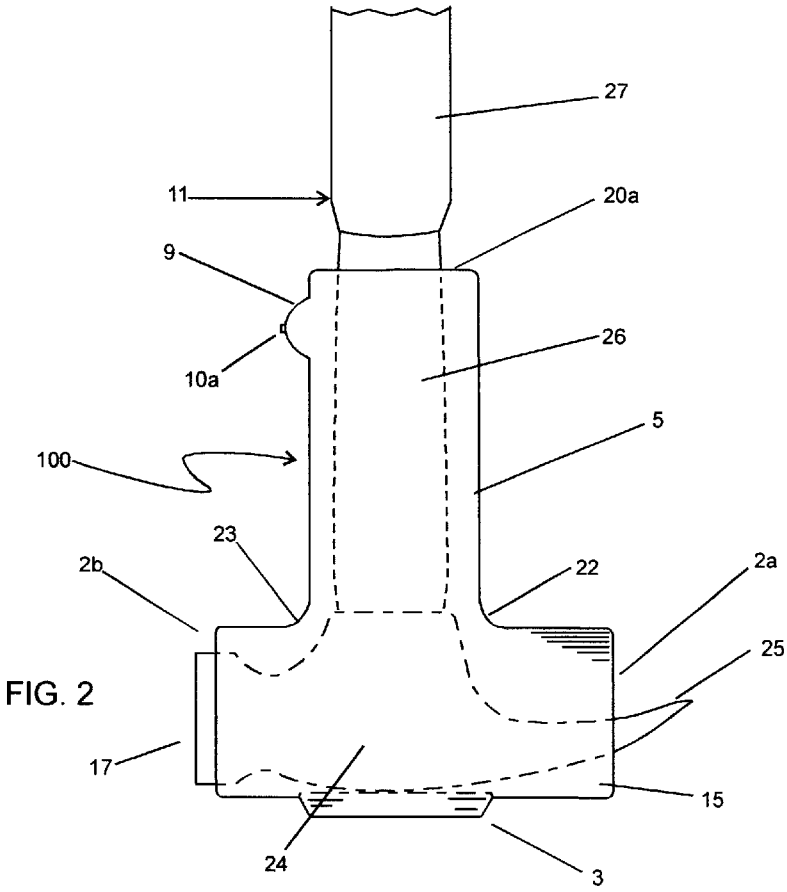
FIG. 2 is a side view of the preferred embodiment of the present invention shown in conjunction with a conventional claw hammer.
Figure 9:
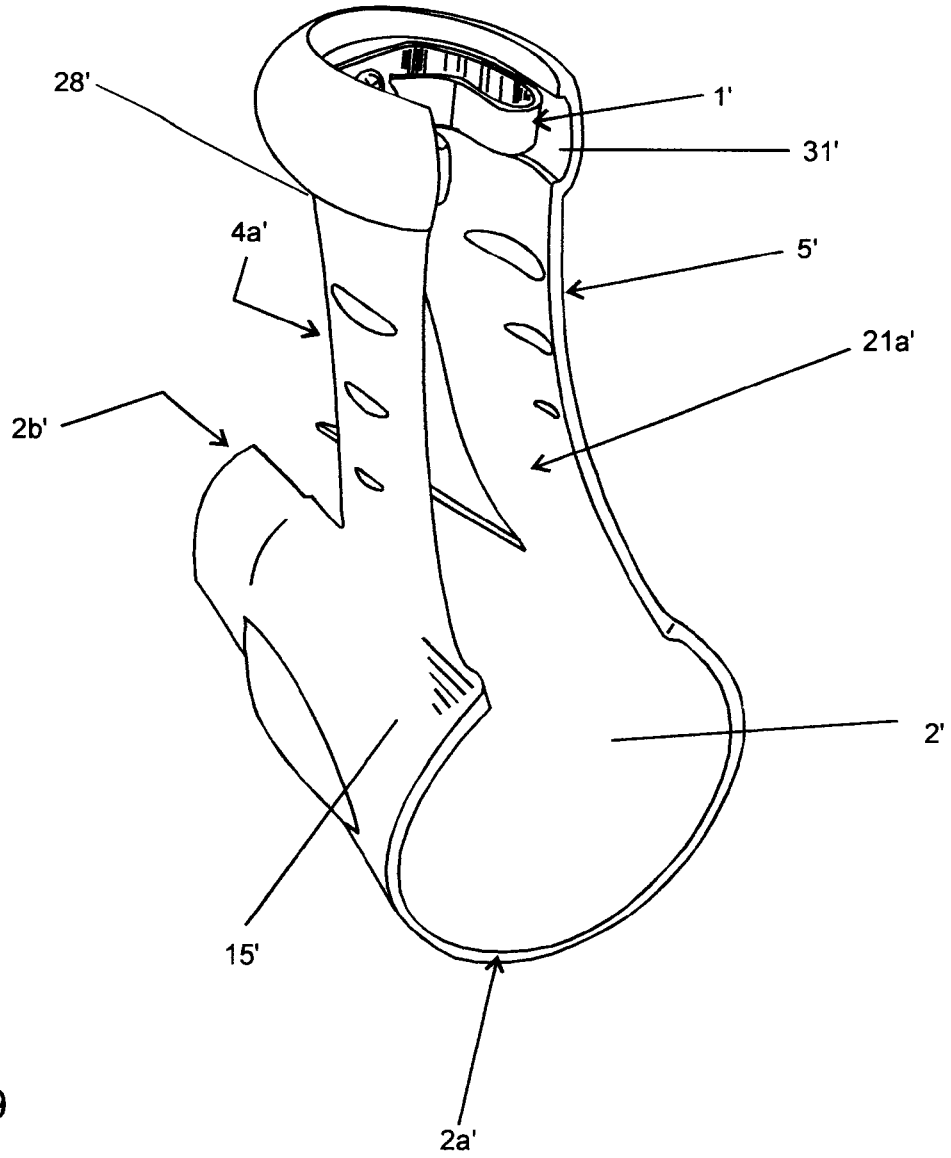
FIG. 9 is a perspective view of another embodiment of the present invention.

As shown in FIGS. 1 and 2, the tool holder of the present invention comprises a body 100 having a hollow horizontal member 15 combined perpendicularly with a hollow vertical member 5. In the most preferred embodiment, body 100 is made of a rigid lightweight material, such as plastic, which can be molded from a integral piece or made from separate members joined together. Horizontal member 15 has a cavity 2 extending from a front opening 2*a* to a rear opening 2*b*. Front opening 2*a* may be the same diameter as rear opening 2*b* thereby making cavity 2 cylindrically shaped (as best shown in FIG. 1), or front opening 2*a*' may be somewhat larger than rear opening 2*b*' thereby making cavity 2' cone-shaped (as best shown in FIG. 9). Vertical portion 5 has a cavity 20 extending from a top opening 20*a* to and communicating with cavity 2 at its midsection. Cavity 20 is open along the front side of vertical member 5 to form a longitudinal channel 21*a* that runs vertically from top opening 20*a* to front side intersection 22 with horizontal member 15. Cavity 2 is open along the top side of horizontal member 15 to form a longitudinal channel 21*b* that runs transversely from front opening 2*a* to front side intersection 22, thereby forming with channel 21*a* an L-shaped channel on the front side of body 100.

As shown in FIG. 2, when a typical claw hammer 11 is inserted into the holder body 100, head 24 of hammer 11 passes through front opening 2*a* and channel 21*b*, and is received into cavity 2 with its primary striking face 17 directed toward the rear and protruding through rear opening 2*b*. Secondary face 25 of head 24 is directed toward the front and protrudes through front opening 2*a*. Having front opening 2*a*' slightly larger than the rear opening 2*b*' (as shown in FIG. 9) makes it easier for the user to hit the opening, particularly when tools with larger heads are used. The smaller diameter of the rear opening 2*b*' aids in preventing the tool from tipping forward in the event that the user accidentally disengages the neck 26 of the tool from the adjustable spring clip 1.

Neck 26 of hammer 11 passes through channel 21*a* so that handle 27 is positioned above head 24 and protruding through top opening 20*a* unimpeded by any holder structure. Channel 21*b* and cavity 2 are sized to receive the head of the tool being held; for example, channel 21*b* may be about 1¼" in width and cavity 2 may be about 2" inner diameter to accommodate head 24 of claw hammer 11. Channel 21*a* and cavity 20 are sized to receive the neck portion of the tool being held; for example, channel 21*a* may be about 1¼" in width and cavity 20 may be about 1½" inner diameter to accommodate neck 26 of claw hammer 11. Of course, other dimensions can be used to accommodate tools of other sizes.

Figure 5:
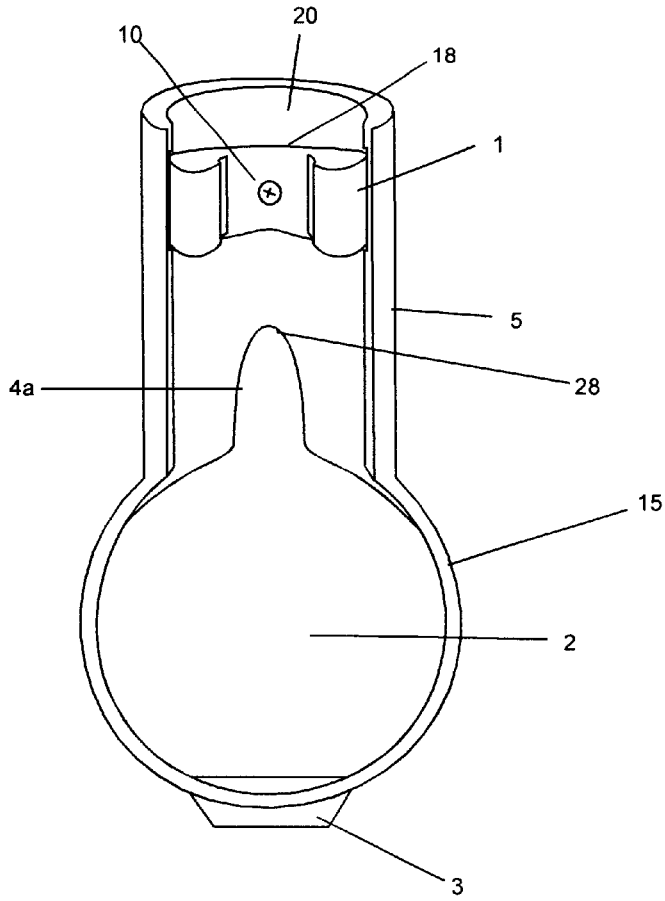
FIG. 5 is a front view of the preferred embodiment.
Figure 6:
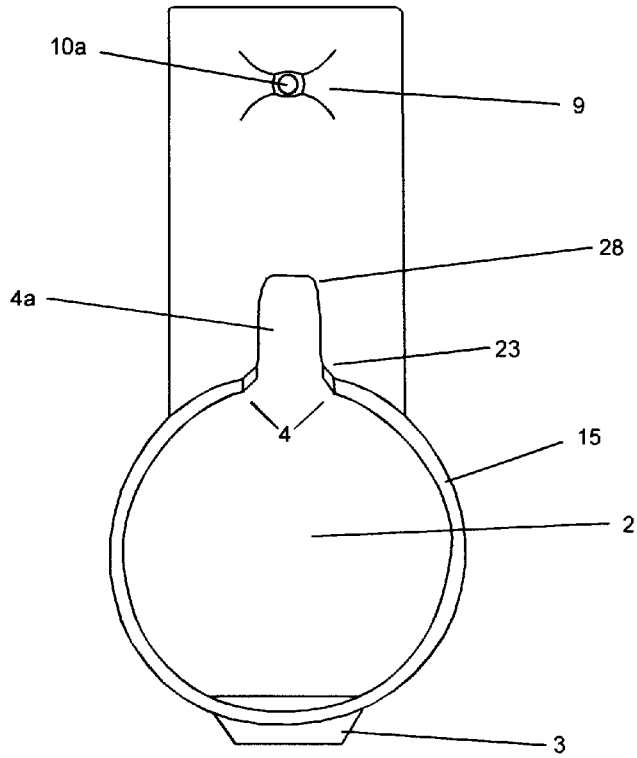
FIG. 6 is a rear view of a preferred embodiment.
Figure 8:
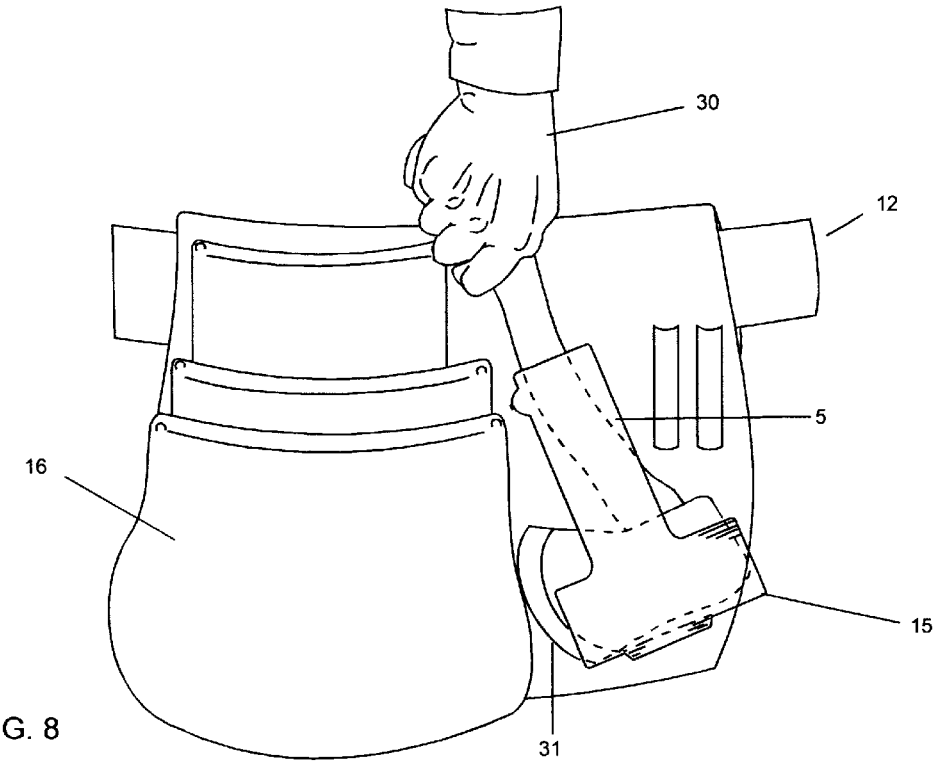
FIG. 8 is similar to FIG. 7 and shows a tool holder of the present invention mounted on a pouch suspended from a user's belt and holding a hatchet.

As best shown in FIGS. 1 and 6, the rear portion of cavity 2 in horizontal member 15 is preferably open along its top side to form a longitudinal channel 4 that runs from rear opening 2*b* transversely to rear side intersection 23 with vertical member 5. Cavity 20 is preferably open along the rear side of vertical member 5 to form a longitudinal channel 4*a* running vertically from rear side intersection 23 to an intermediate point 28 thereon. Together channels 4 and 4*a* form a truncated L-shaped channel, preferably the length and width of which accommodate the elongated striking face (blade) 31 of a hatchet or axe, when the tool holder of the present invention is used for these types of tools (as shown in FIG. 8). Channel 4*a* may be relatively small (as shown in FIGS. 1, 5 and 6) or channel 4*a*' may be of size slightly smaller than channel 21*a*' (as shown in FIG. 9) with the intermediate point 28' located just below spring clip 1'.

Horizontal member 15 preferably contains means for securing the head of the tool in cavity 2. As best shown in FIGS. 2, 5 and 6, horizontal member 15 preferably contains a magnet 3 that is embedded into the bottom of cavity 2. When a tool having a metal head, such as head 24 of claw hammer 11, is placed in the holder as previously described, head 24 bonds to the magnet 3, thereby holding it securely in cavity 2. Magnet 3 should be of sufficient strength to provide a reasonably secure magnetic bond with the metal tool head, but not so strong as to impair the user's ability to easily remove the tool from the holder. Magnet 3 is also shaped in a way to create a flat bottom inside cavity 2 to prevent the tool from tipping forward.

Figure 3:
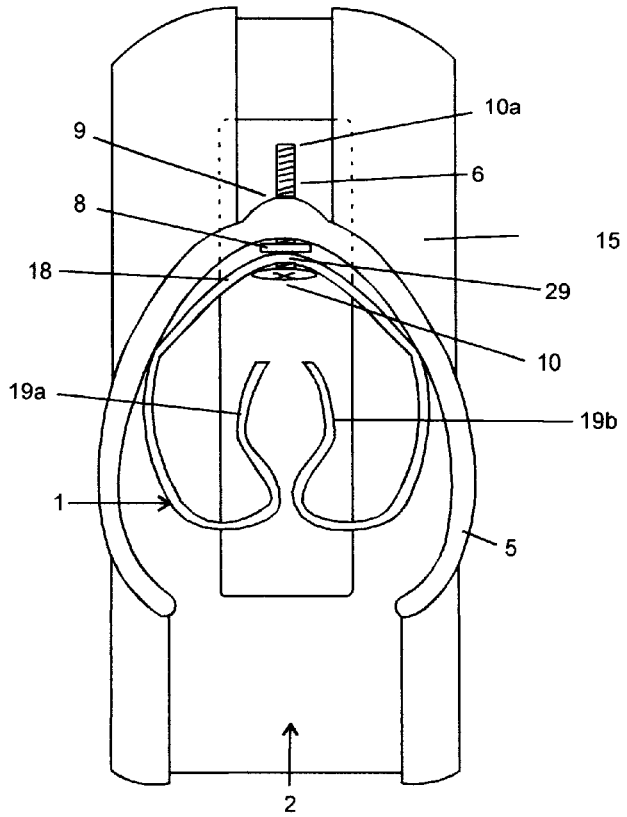
FIG. 3 is a top view of the preferred embodiment, showing the adjustable clip in its narrowest position.
Figure 4:
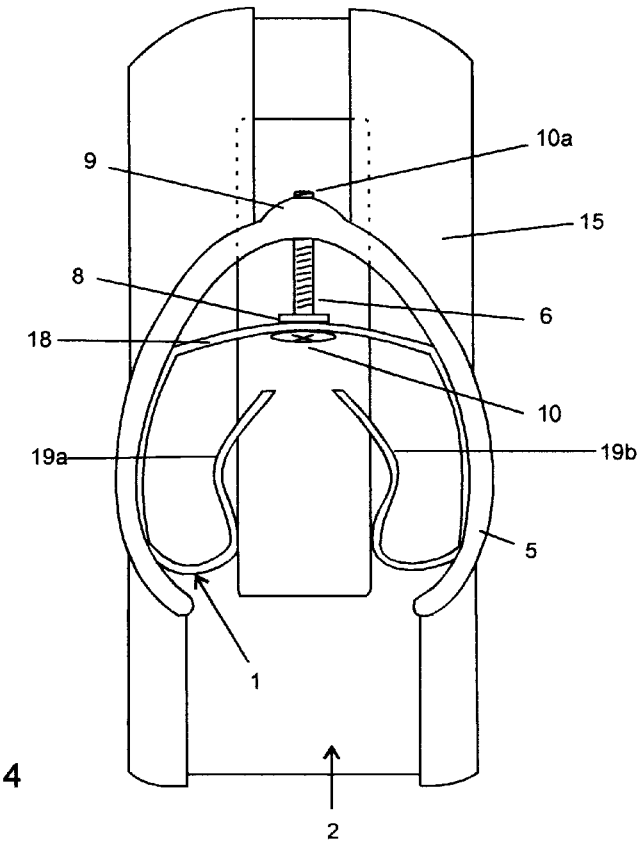
FIG. 4 is a top view similar to FIG. 3 with the adjustable clip shown in its widest position.

The sidewalls of vertical member 5 may be solid (as shown in FIG. 1) or vertical member 5' may contain various openings 28' to decrease the overall weight of the holder (as shown in FIG. 9). Vertical member 5 preferably also contains means for securing the neck of the tool in cavity 20 in such a way that the handle is left freely available for grasping by the hand of the user. Spring clip 1 is preferably disposed, to prevent unwanted spinning or twisting, in track 31'(as best shown in FIG. 9) of cavity 20 near the top of vertical member 5 adjacent top opening 20*a*. Suitable clips are known in the art, for example, U.S. Pat. No. 1,711,730, describes a clip that may be used in the present invention. As shown in FIGS. 3 and 4, spring clip 1 comprises a strip of sheet material with a normally straight attaching portion 18 having on either end a pair of spaced arcuate bows continuously curved towards each other from opposite directions, then away from each other and towards one another again to form gripping arms 19*a* and 19*b*, which define with each other an open-ended recess within which the neck of the tool is gripped.

In the preferred embodiment, spring clip 1 is made of spring steel and has an adjustable feature that allows the clip to accommodate different sizes of tool necks and/or provide varying amounts of gripping pressure on the tool neck being held. Spring clip 1 may be attached to the rear wall of vertical member 5 by means of a machine screw 6 that passes through hole 29 in spring clip 1 and threads into an embedded receiving element 9. Machine screw tip 10*a* advances through receiving element 9 as machine screw 6 is tightened and loosened against attaching portion 18 of spring clip 1. Machine screw 6 preferably has a fine thread to allow the most precise adjustment. Receiving element 9 is preferably a threaded fastener with a means for reducing vibration, such as a nylon insert, that will help prevent unwanted loosening of machine screw 6. The placement of adjustable spring clip 1 in cavity 20 allows it to engage only the neck of a tool, for example, neck 26 of hammer 11, when the tool is placed in the holder. This feature leaves the handle completely free so that the user's hand can remain on the handle during insertion and withdrawal of the tool, without the impediments of prior art holders that engage the handle or are mounted on a back plate in such a way that natural access to the handle is impeded.

In the preferred embodiment, spring clip 1 automatically engages the neck of a tool when the tool is placed in the holder and downward pressure is exerted on the handle. The retention pressure exerted by the clip must be great enough to securely hold the tool in place under normal working conditions and prevent the tool from accidentally falling out of the holder. However, the pressure must also be light enough that the user can easily remove and replace the tool with minimal effort. The distance between gripping arms 19*a* and 19*b* of adjustable spring clip 1, which determines the amount of pressure exerted by the clip on the tool neck, is conveniently adjusted by turning the head 10 of machine screw 6 with a screwdriver. When machine screw 6 is in its loosest position, gripping arms 19*a* and 19*b* of adjustable clip 1 are the widest distance apart, as shown in FIG. 4. When machine screw 6 is tightened by turning the head of machine screw head 10 to the right, attaching portion 18 of adjustable spring clip 1 is forced into the curvature of vertical member 5, which causes attaching portion 18 to bend, thereby forcing gripping arms 19*a* and 19*b* closer together and increasing the pressure exerted on the tool neck. By fully tightening machine screw 6, gripping arms 19*a* and 19*b* of adjustable spring clip 1 will be the closest distance apart, as shown in FIG. 3. Machine screw 6 may have a disc 8 of minimal thickness affixed to it immediately after it passes through hole 29 in the attaching portion 18 of adjustable spring clip 1. Disc 8 forces the attaching portion 18 of the adjustable spring clip 1 to bend away from the curvature of vertical member 5 when machine screw 6 is loosened, which forces gripping arms 19*a* and 19*b* farther apart. The user is thus able to adjust the gripping pressure of adjustable spring clip 1 to custom fit the holder of the present invention to the neck of the tool that the user intends to place in the holder. The distance between gripping arms 19*a* and 19*b* is infinitely adjustable within the range established by the length of machine screw 6 and the depth of cavity 20.

Figure 7:
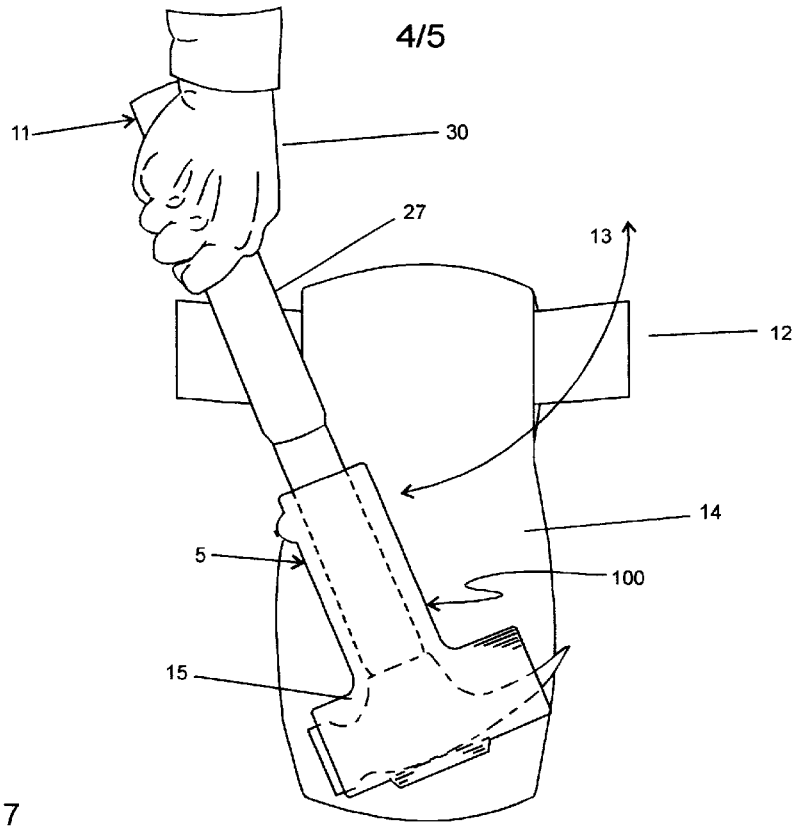
FIG. 7 is a side view showing a tool holder of the present invention mounted on a scabbard suspended from a user's belt and holding a carpenter's hammer.

The holder of the present invention is particularly well adapted for attachment to the outward side of a generally flat back panel member that is suspended from a user's belt by suitable means, but also can be mounted on a wall, tool chest or other structure. Examples of representative back panel members are tool scabbard 14 in FIG. 7 and tool pouch 16 in FIG. 8. Holder body 100 is conveniently mounted to the back panel member by conventional fastening means such as rivets or threaded fasteners (not shown) through mounting holes 7 (FIG. 1) located in the inward sidewalls of vertical member 5 and horizontal member 15. Holder body 100 may be oriented on the back panel member so that the axis of vertical member 5 (and therefore the handle of the tool being held therein) is disposed at an angle anywhere between (and including) a vertical position and (moving counterclockwise) a horizontal position. Of course, channel 21*a*-21*b* of holder body 100 must be maintained in an upward position so that the tool is cradled therein without falling out. In other words, the holder body may be oriented so that it holds the tool handle anywhere from a vertical position, wherein the handle is directly above the head, to a horizontal position, wherein the handle is directly behind the head. Most preferably, the axis of vertical member 5 is maintained at about a 45° angle counterclockwise from the vertical (see FIG. 7), so that the user's hand 30 can naturally grasp handle 27 and swing hammer 11 along arc 13 out of and into holder body 100.

The present invention has been described with reference to particular embodiments. These embodiments should not be construed as limiting the scope of the invention, but merely providing illustrations of the invention. Accordingly, the scope of the present invention should be determined by the following claims and their legal equivalents, rather than the examples given.

I claim:

1. A device for holding a manual hand tool having a handle, neck and transversely mounted head with a striking face, said device comprising:

a T-shaped body having perpendicular horizontal and vertical cavities each open on the front side thereof to a longitudinal channel thereby allowing the head of the tool to access the horizontal cavity and the neck of the tool to access the vertical cavity;

the horizontal cavity having securing means for holding the head of the tool therein with the striking face in the rearward direction; and the vertical cavity having securing means for holding the neck of the tool therein with the handle protruding freely therefrom in a position allowing the user to maintain his grip on the handle while removing and inserting the tool in a natural swinging arc.

2. A device according to claim 1 wherein the tool is selected from the group consisting of hammers, axes, hatchets, picks and pry bars.

3. A device according to claim 1 wherein the tool neck securing means in the vertical cavity is an adjustable spring clip.

4. A device according to claim 1 wherein the tool head securing means in the horizontal cavity is a magnet positioned in the bottom of the horizontal cavity.

5. A device according to claim 1 further comprising a generally flat back panel member having means for attaching to a user's belt, said body being fixedly mounted on the outward side of the back panel member so as to orient the axis of the vertical cavity in a position ranging from vertical wherein the handle is located directly above the head of the tool to horizontal wherein the handle is located directly behind the head of the tool.

6. A device as described in claim 1 wherein the tool is a hammer.

7. A device for carrying a T-shaped or L-shaped manual hand tool in a secure and readily available position which comprises:

a generally flat back panel member having means for attaching to a user's belt; and a tool holder comprising a body with a hollow horizontal member having a cavity extending from a front opening to a rear opening; and a hollow vertical cylindrical member extending perpendicularly above the horizontal member and having a cavity extending from a top opening to and communicating with the mid-section of the horizontal member cavity;

the vertical member cavity being open along the front side of the vertical member to form a longitudinal channel running from the top opening to the intersection with the horizontal member, and the horizontal member cavity being open along the top side of the horizontal member to form a longitudinal channel running from the front opening of the horizontal member cavity to the intersection with the vertical member, thereby forming an L-shaped channel on the front side of the body;

the horizontal member cavity being adapted to receive the head of the tool through the front opening and horizontal member channel with the striking face facing rearwardly and extending through the rear opening thereof;

the vertical member cavity being adapted to receive the neck of the tool through the vertical member channel with the entire handle of the tool freely extending out of and beyond the top opening of the vertical member cavity;

the horizontal member cavity having means for securing the head of the tool therein and the vertical member cavity having means for securing the neck of the tool therein;

the tool holder body being attached on the outward side of the back panel member so as to orient the axis of the vertical member at an angle between and including a vertical position wherein the handle of the tool being held in the body is directly above the head of the tool, and a horizontal position wherein the handle of the tool being held in the body is directly behind the head of the tool;

said angle allowing the user to maintain his grip on the handle in a natural position while removing and inserting the tool in a natural swinging arc.

8. A device as described in claim 7 wherein the angle of the axis of the vertical member is about a 45° angle counterclockwise from the vertical.

9. A device according to claim 7 wherein the tool neck securing means in the vertical member cavity is a spring clip comprising a strip of sheet material with a normally straight attaching portion having on either end thereof a pair of spaced arcuate bows continuously curved towards each other from opposite directions, then away from each other and towards one another again to form gripping arms which define with each other an open-ended recess within which the neck of the tool is gripped.

10. A device according to claim 9 wherein the spring clip includes means to adjust the distance between the gripping arms to thereby change the size of the recess so as to accommodate different sizes of tool necks and/or provide varying amounts of gripping pressure on the tool neck being held.

11. A device according to claim 10 wherein said adjusting means is a threaded fastener extending through a hole in the attaching portion of the spring clip into a threaded receiving element in the side of the vertical member cavity such that tightening the fastener forces the attaching portion of the spring clip to bend and thereby force the gripping arms closer together, and loosening the fastener allows the attaching portion of the spring clip to straighten out and force the gripping arms farther apart.

12. A device according to claim 7 wherein the rear portion of the horizontal member is open along its top side to form a longitudinal channel that runs from the rear opening of the horizontal member cavity to the intersection with the vertical member, and the vertical member cavity is open along its rear side to form a longitudinal channel running from the intersection with the horizontal member to an intermediate point, thereby forming a truncated L-shaped channel on the rear side of the body.

13. A device according to claim 7 wherein the tool is a hammer.

* * * * *